United States Patent [19]

Sakamaki et al.

[11] Patent Number: 5,032,070

[45] Date of Patent: Jul. 16, 1991

[54] ROTARY MACHINE HAVING AXIALLY BIASED RING FOR LIMITING RADIAL VANE MOVEMENT

[75] Inventors: Hiroshi Sakamaki; Yukio Horikoshi; Takeshi Jinnouchi; Kenji Tanzawa, all of Sakado, Japan

[73] Assignee: Eagle Industry Co., Ltd., Tokyo, Japan

[21] Appl. No.: 394,785

[22] Filed: Aug. 16, 1989

Related U.S. Application Data

[60] Division of Ser. No. 197,548, May 23, 1988, Pat. No. 4,958,995, which is a continuation-in-part of Ser. No. 75,006, Jul. 17, 1987, abandoned, and a continuation-in-part of Ser. No. 110,919, Oct. 21, 1987, abandoned, and a continuation-in-part of Ser. No. 113,568, Oct. 26, 1987, abandoned, and a continuation-in-part of Ser. No. 115,677, Oct. 30, 1987, abandoned.

[30] Foreign Application Priority Data

| | | | |
|---|---|---|---|
| Jul. 22, 1986 | [JP] | Japan | 61-111490[U] |
| Jul. 22, 1986 | [JP] | Japan | 61-170903 |
| Oct. 23, 1986 | [JP] | Japan | 61-161609[U] |
| Oct. 23, 1986 | [JP] | Japan | 61-161610[U] |
| Nov. 4, 1986 | [JP] | Japan | 61-168145[U] |
| Nov. 4, 1986 | [JP] | Japan | 61-168147[U] |
| Nov. 14, 1986 | [JP] | Japan | 61-269960[U] |
| Nov. 14, 1986 | [JP] | Japan | 61-269961 |
| Nov. 17, 1986 | [JP] | Japan | 61-271934 |
| Nov. 21, 1986 | [JP] | Japan | 61-178287[U] |
| Nov. 21, 1986 | [JP] | Japan | 61-178288[U] |
| Nov. 21, 1986 | [JP] | Japan | 61-276689 |
| Nov. 21, 1986 | [JP] | Japan | 61-276690 |
| Dec. 3, 1986 | [JP] | Japan | 61-185571[U] |

[51] Int. Cl.[5] ..... F01C 1/344

[52] U.S. Cl. ..... 418/257; 418/265

[58] Field of Search ..... 418/135, 256, 257, 260, 418/261, 264, 265

[56] References Cited

FOREIGN PATENT DOCUMENTS 430365 6/1935 United Kingdom ..... 418/265

*Primary Examiner*—John J. Vrablik

*Attorney, Agent, or Firm*—Jordan and Hamburg

[57] ABSTRACT

A rotary machine includes a housing having a rotor chamber and a rotor rotatably mounted in the rotor chamber. The rotor has longitudinal ends and a plurality of generally radially disposed vane slots extending between the longitudinal ends. A plurality of vanes are slidably mounted in the vane slots and operable to define variable volume chambers as the rotor rotates and the vanes move generally radially in and out of the vane slots. Rings are rotatably mounted on the housing and limiting devices are provided between the rings and the vanes and are operable to limit the extent of outward radial movement of the vanes from their respective vane slots during rotation of the rotor to preclude sliding contact between the vanes and the inner peripheral surface of the housing. Biasing springs on the housing are engageable with the rings and bias the rings in an axial direction toward the longitudinal ends of the rotor to thereby suppress axial oscillation of the rings and stabilize the rotation of the rings.

20 Claims, 11 Drawing Sheets

ROTARY MACHINE HAVING AXIALLY BIASED RING FOR LIMITING RADIAL VANE MOVEMENT

RELATED APPLICATIONS

This is a division application of U.S. Ser. No. 197,548, filed May 23, 1988, now U.S. Pat. No. 4,958,995, which is a continuation-in-part application of U.S. Ser. No. 075,006 filed Jul. 17, 1987, abandoned; U.S. Ser. No. 110,919 filed Oct. 21, 1987, abandoned; U.S. Ser. No. 113,568 filed Oct. 26, 1987, abandoned; and U.S. Ser. No. 115,677 filed Oct. 30, 1987, abandoned.

BACKGROUND OF THE INVENTION

The present invention relates to a vane pump which is one of rotary pumps used for various kinds of apparatuses such as a supercharger of an engine, a compressor of a freezing cycle, and the like.

A vane pump schematically shown in FIG. 13 has been heretofore widely known.

In FIG. 13, reference numeral 101 designates a housing; 102, a rotor inserted eccentrically into an inner peripheral space of the housing 101 and rotatably supported by a rotational shaft 103; 105*a*, 105*b* and 105*c*, plate-like vanes disposed radially retractably from vane grooves 104*a*, 104*b* and 104*c* equally spaced apart so as to peripherally divide the outer peripheral side of the rotor 102 into three sections. When the rotor 102 is rotated in the direction as indicated by the arrow X by the rotational shaft 103, the vanes 105*a*, 105*b* and 105*c* are moved out in the direction of the outside diameter by the centrifugal force, and the end edges thereof rotate while slidably contacting the inner peripheral surface of the housing 101. Since the rotor 102 is eccentric with respect to the housing 101 as previously mentioned, as such rotation occurs, volumes of working spaces 106*a*, 106*b* and 106*c* defined by the housing 101, the rotor 102 and the vanes 105*a*, 105*b* and 105*c* are repeatedly enlarged and contracted to allow a fluid taken in from an intake port 107 to be discharged out of an outlet port 108.

However, the above-described conventional vane pump has problems that since the vanes slidably move along the inner peripheral surface of the housing at high speeds, the efficiency of the volume caused by the great power loss due to the sliding resistance and by the generation of high sliding heat unavoidably deteriorates; the vanes materially become worn; and the vanes are expanded due to the generation of sliding heat to produce a galling with the inner side surfaces of both end walls of the housing, and the like.

In view of these problems as noted above, it is an object of the present invention to enhance the efficiency of such a pump and enhance the durability thereof.

SUMMARY OF THE INVENTION

To obtain the aforementioned objects, a vane pump according to the present invention includes a housing having a rotor chamber and a rotor rotatably mounted in the rotor chamber. The rotor has longitudinal ends and a plurality of generally radially disposed vane slots extending between the longitudinal ends. A plurality of vanes are slidably mounted in the vane slots and operable to define variable volume chambers as the rotor rotates and the vanes move generally radially in and out of the vane slots. Rings are rotatably mounted on the housing and limiting devices are provided between the rings and the vanes and are operable to limit the extent of outward radial movement of the vanes from their respective vane slots during rotation of the rotor to preclude sliding contact between the vanes and the inner peripheral surface of the housing. Biasing springs on the housing are engageable with the rings and bias the rings in an axial direction toward the longitudinal ends of the rotor to thereby suppress axial oscillation of the rings and stabilize the rotation of the rings.

While the present invention has been briefly outlined, the above and other objects and new features of the present invention will be fully understood from the reading of the ensuing detailed description in conjunction with embodiments shown in the accompanying drawings. It is to be noted that the drawings are exclusively used to show certain embodiments for the understanding of the present invention and are not intended to limit the scope of this invention.

DESCRIPTION OF THE PREFERRED EMBODIMENTS

A fundamental exemplification of a vane pump according to the present invention will now be described with reference to FIGS. 1 to 3.

Figure 1:
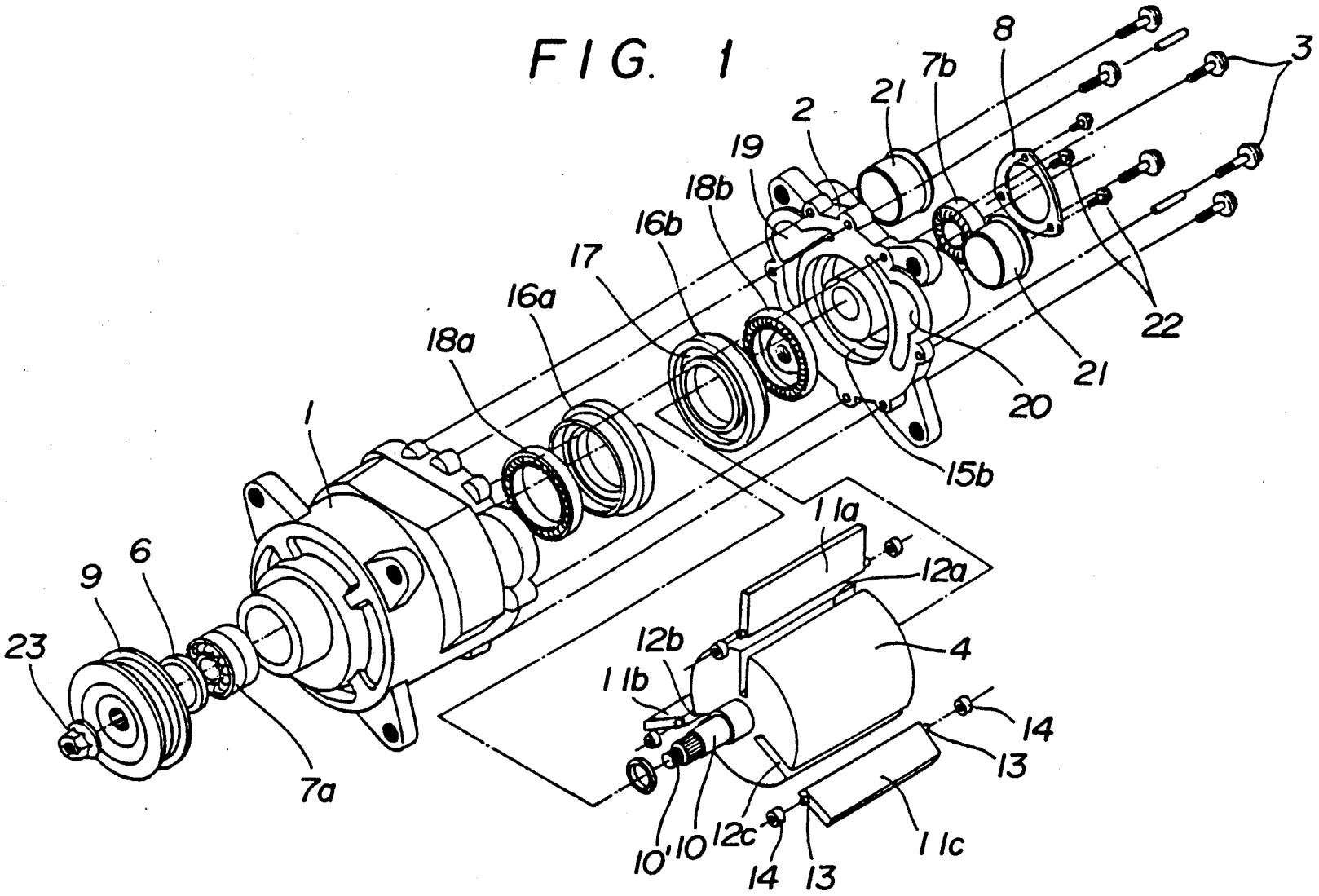
FIG. 1 is an exploded perspective view of a vane pump according to a fundamental embodiment of the present invention.
Figure 2:
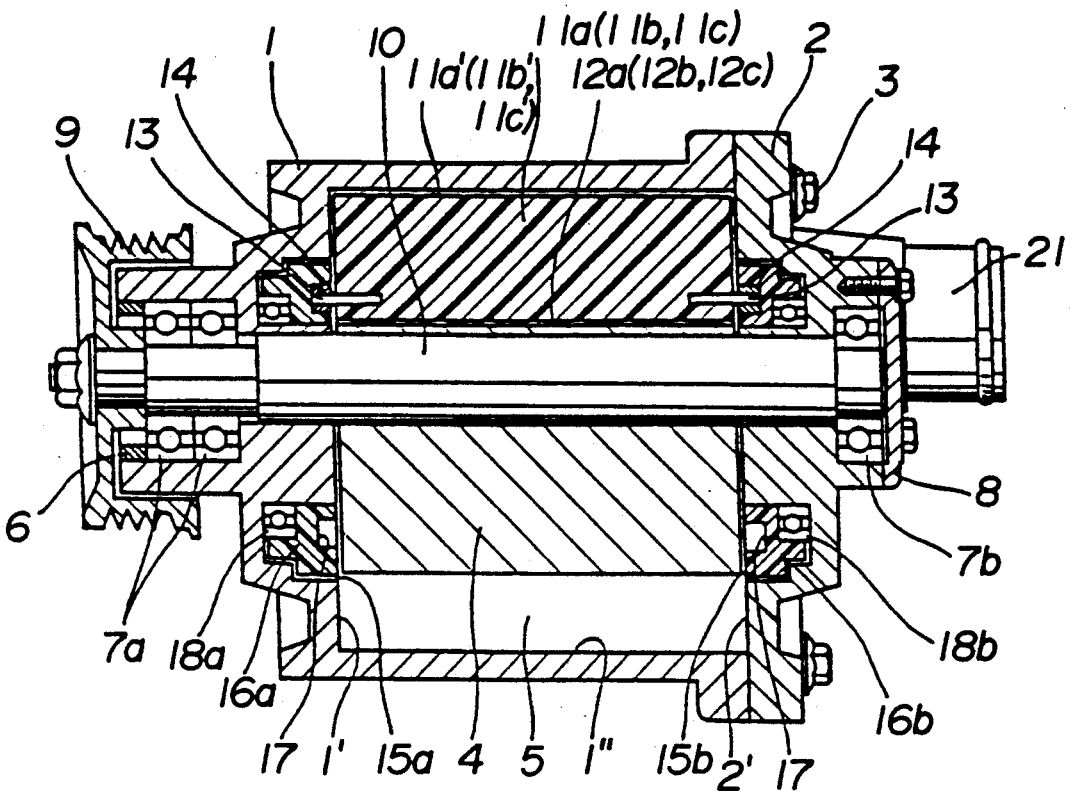
FIG. 2 is a sectional view showing the pump of FIG. 1 assembled.
Figure 3:
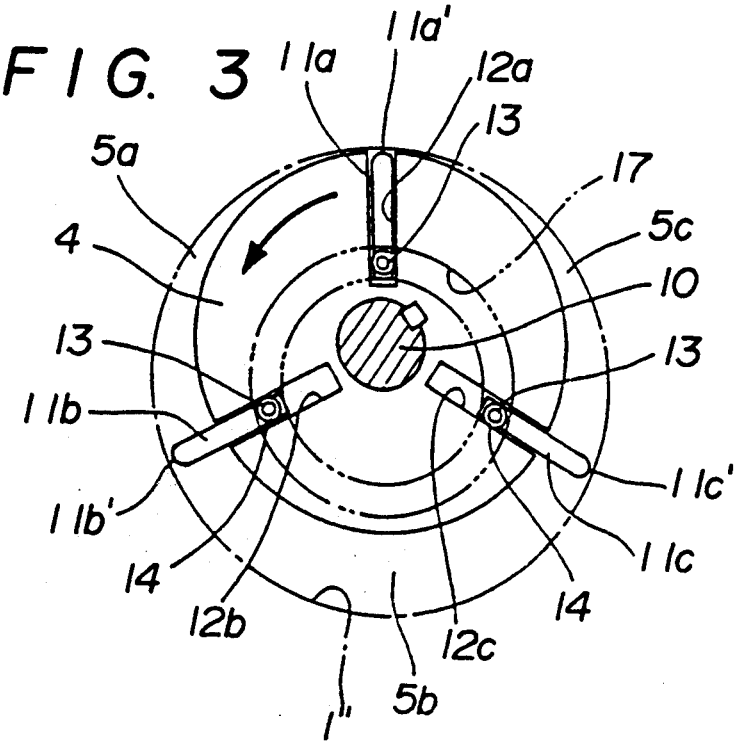
FIG. 3 is a side view of a rotor of the same pump of FIG. 1.

In FIGS. 1 and 2, a front housing 1 and a rear housing 2, both of which housings are made of non-ferrous metal such as aluminum, which is light in weight and is small in the coefficient of thermal expansion, are secured integral with each other by means of bolts 3. A rotor 4 made of iron eccentrically inserted into an inner peripheral space 5 of the housing is extended through both the housings 1 and 2 through a ball bearing 7*a* held by a fixed ring 6 in anti-slipout fashion in an axial shoulder of the front housing 1 and a ball bearing 7*b* held by a bearing cover 8 in anti-slipout fashion in an axial shoulder of the rear housing 2 and is rotatably mounted on a rotational shaft 10 to which a drive force is transmitted from a pulley 9. Plate-like vanes 11*a*, 11*b* and 11*c* principally made of a carbon material having an excellent slidability are disposed to be radially projected and retracted in vane grooves 12*a*, 12*b* and 12*c*, respectively, which are formed in the form of depressions equally spaced apart so as to peripherally divide the outer peripheral side of the rotor 4 into three sections, on the rotor 4. On opposite ends of each of the vanes 11*a*, 11*b* and 11*c* corresponding to axial opposite sides of the rotor 4 are projected steel pins 13 and 13, respectively, and a sleeve bearing 14 made of resin having excellent slidability and abrasion resistance is slipped over each of pins 13. In annular recesses 15*a* and 15*b* formed in inner surfaces 1' and 2' of end walls where the front housing 1 and the rear housing 2 are opposed to each other coaxial with the inner peripheral space 5 of the housing (coaxial with the inner peripheral surface 1'' of the front housing 1), retainer rings 16*a* and 16*b* made of non-ferrous metal such as aluminum and each having an annular race 17 are rotatably fitted through ball bearings 18*a* and 18*b*, respectively. The pins 13 and 13 projected on the respective vanes 11*a*, 11*b* and 11*c* peripherally slidably engage the annular races 17 and 17 of the retainer rings 16*a* and 16*b* through the respective sleeve bearings 14. This engagement defines the radial movement of the vanes 11*a*, 11*b* and 11*c* during rotation so as to maintain a state in which there is formed a slight clearance between the end edges 11*a'*, 11*b'* and 11*c'* (see FIG. 3) thereof and the inner peripheral surface 1'' of the front housing 1. An intake port 19 for guiding a fluid into the inner peripheral space 5 of the housing from the exterior of the pump and an outlet port 20 for guiding a fluid to the exterior from the inner peripheral space 5 of the housing are formed in the rear housing 2. Reference numerals 21, 21 designate tubes mounted on the intake port 19 and outlet port 20, respectively; 22 a bolt used to secure the bearing cover 8 to the rear housing 2; and 23, a nut in engagement with an external thread 10' of the end of the rotational shaft 10 in order to secure the pulley 9 to the rotational shaft 10.

The operation of the above-described vane pump will be described hereinafter. When the rotational shaft 10 and rotor 4 are rotated by the drive force from the pulley 9, the vanes 11*a*, 11*b* and 11*c* also rotate, and the pins 13 and 13 projected on the vanes 11*a*, 11*b* and 11*c*, respectively, and the sleeve bearings 14 and 14 slipped over the pins 13 and 13 rotate along the annular races 17 and 17. Since as shown in FIG. 3, the inner peripheral surface 1'' of the housing and the annular race 17 are in coaxial relation and the annular race 17 and the rotor 4 are in eccentric relation, the vanes 11*a*, 11*b* and 11*c* are radially slidably moved in the vane grooves 12*a*, 12*b* and 12*c* of the rotor 4 to be projected and retracted repeatedly with the result that the volumes of the working spaces 5*a*, 5*b* and 5*c* defined by both the housings 1, 2, the rotor 4 and the vanes 11*a*, 11*b* and 11*c* repeatedly increase and decrease. That is, in FIG. 3, the working space 5*a*, with the rotation, increases its volume to suck the fluid from the intake port 19 (not shown; see FIG. 1) opening to portion 5*a*; the working space 5*c*, with the rotation, decreases its volume to discharge the fluid into the outlet port 20 (not shown; see FIG. 1) opening to portion 5*c*; and the working space 5*b* transfers the thus sucked fluid toward the outlet port 20. In the above-described operation, the end edges 11*a'*, 11*b'* and 11*c'* of the vanes 11*a*, 11*b* and 11*c* are not in sliding contact with the inner peripheral surface 1'' of the front housing, as previously mentioned, and therefore, abrasion or high heat hardly occurs. In addition, the sleeve bearing 14 slipped over the pin 13 is slidably rotated while being pressed against the outside diameter side by the centrifugal force within the annular race 17 of the retainer rings 16*a* and 16*b* while the retainer rings 16*a* and 16*b* follow the sleeve bearing 14 for rotation because the former are in the state to be rotatable by the ball bearings 18*a* and 18*b*, respectively. The relative sliding speed between the sleeve bearing 14 and the annular race 17 is low whereby the abrasions of annular race 17, retainer rings 16*a* and 16*b*, the sleeve bearing 14 and the like can be minimized.

It is believed that the fundamental mode of the present invention is now fully understood from the above-described description. The pump shown in FIGS. 1 to 3 constitutes, in a sense, the core of the variations described below.

Figure 4:
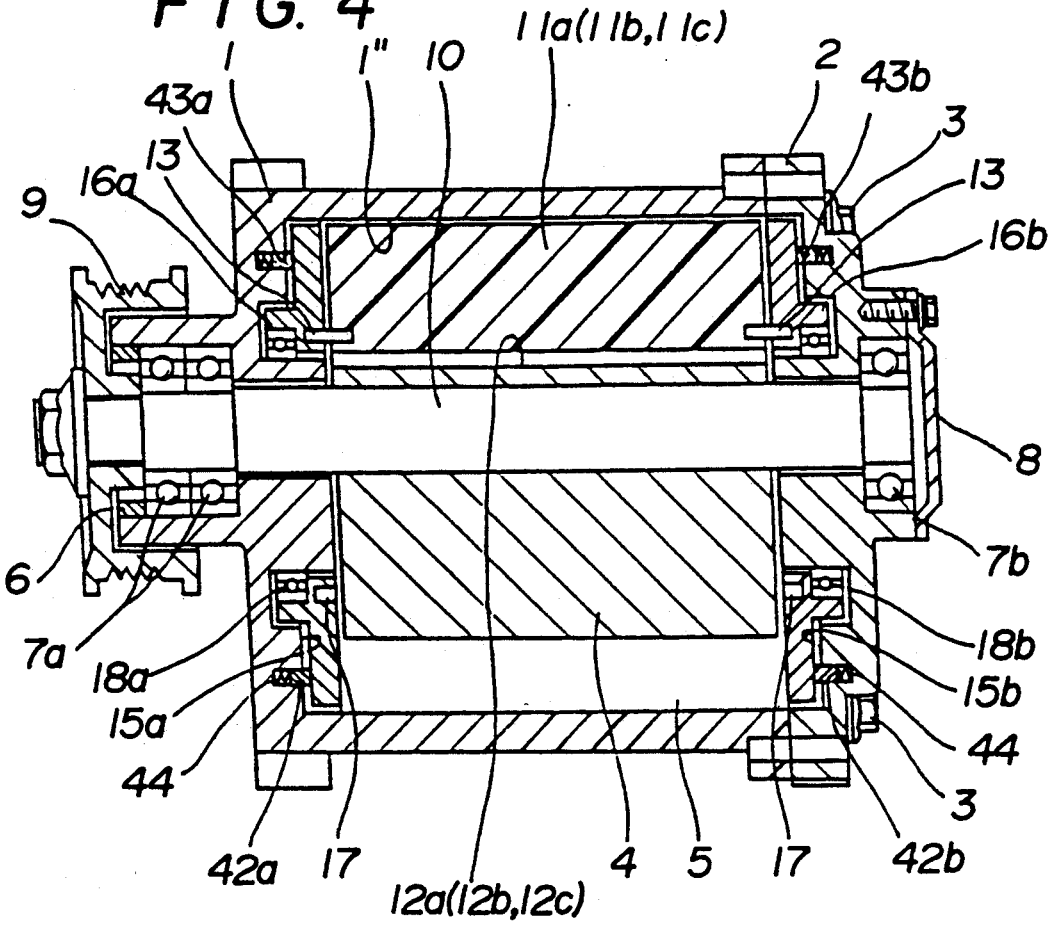
FIG. 4 is a sectional view of a vane pump belonging to one embodiment of the invention.

A vane pump belonging to the embodiment of FIG. 4 is characterized in that a retainer ring coaxial with an inner peripheral space of a housing is fitted through a bearing internally of the end wall of the housing, and the retainer rings are engaged with the aforesaid vanes to define the protrusion of the vanes from the vane grooves, and a backup ring to suppress the oscillation of the retainer rings is interposed between the retainer ring and the end wall of the housing.

Since in the vane pump of FIG. 4, the backup ring is interposed between the retainer ring and the end wall of the housing to suppress the oscillation of the retainer ring caused by the oscillation of the bearing in the thrust direction, the retainer ring may be smoothly rotated and the vane may be smoothly projected and retracted.

As has been described so far and as again shown in FIG. 4, a clearance between members such as the rotor 4, retainer rings 16*a*, 16*b*, and vanes 11*a*, 11*b*, 11*c* to be projected and retracted with the rotation is set to be extremely small in view of the improvement in the pump efficiency. In addition, the vanes 11*a*, 11*b* and 11*c* are supported on the retainer rings 16*a* and 16*b* by the engagement between the pins 13 and the annular races 17, respectively, and the retainer rings 16*a* and 16*b* themselves need be firmly supported so as not to cause oscillations of the retainer rings 16*a* and 16*b* and smoothly rotated in order that the vanes 11*a*, 11*b* and 11*c* may be smoothly projected and retracted. However, practically, the retainer rings 16*a* and 16*b* are axially oscillated by the oscillations of the ball bearings 18*a* and 18*b* in the thrust direction and by the distribution of pressure within the working space 5, resulting in the contact thereof with the end walls of the housings 1 and 2, as a consequence of which the vanes 11*a*, 11*b* and 11*c* tend to be deviated or inclined. In the pump as herein proposed, taking this into consideration beforehand, backup rings 42*a* and 42*b* are interposed between the retainer rings 16*a* and 16*b* and the housings 1 and 2 to prevent the oscillations of the retainer rings 16*a* and 16*b*. The backup rings 42*a* and 42*b* formed of carbon or non-lubricated sliding material such as resins are fitted in annular grooves 43*a* and 43*b* positioned in parts of the annular recesses 15*a* and 15*b* formed in the end walls of the housings 1 and 2, the ends of which are placed in abutment with the backs of the retainer rings 16*a* and 16*b*. The backup rings are strengthened in supporting force by employment of a number of coil springs 44 as necessary to prevent oscillations of the retainer rings 16*a* and 16*b* so that the retainer rings 16*a* and 16*b* may not contact with the end walls of the housings to indirectly secure the smooth operation of the vanes 11*a*, 11*b* and 11*c*.

As described above, according to the vane pump as described above, the backup rings are provided on the backs of the retainer rings to suppress the oscillations of the retainer rings to stabilize the rotation of the retainer rings. Therefore, it becomes possible to smoothly project and retract the vanes, thus preventing harmful influences resulting therefrom.

A further exemplification of a vane pump according to the present invention will be described hereinafter with reference to FIGS. 5 to 7.

Figure 5:
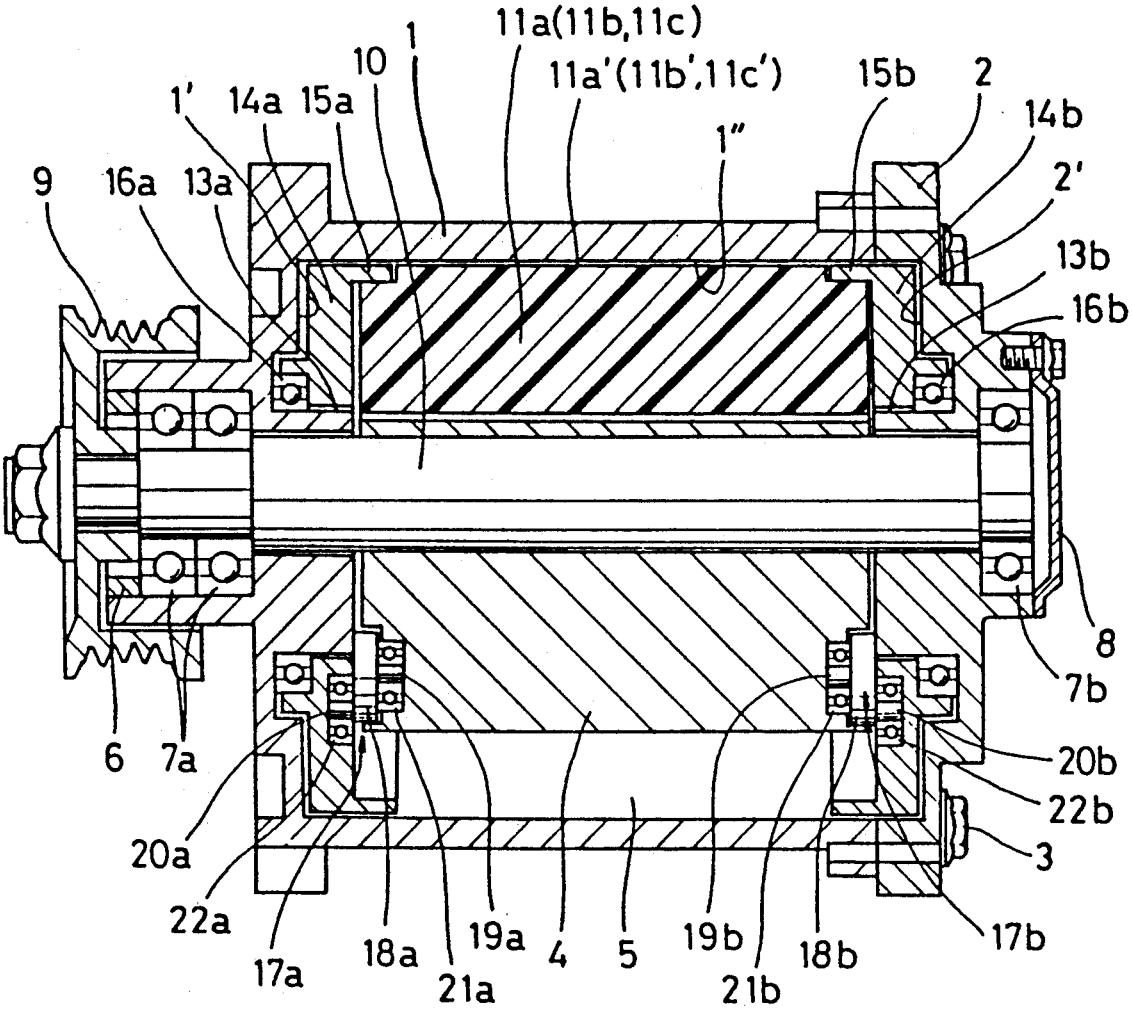
FIG. 5 is a sectional view of a vane pump according to another exemplification of the present invention.
Figure 6:
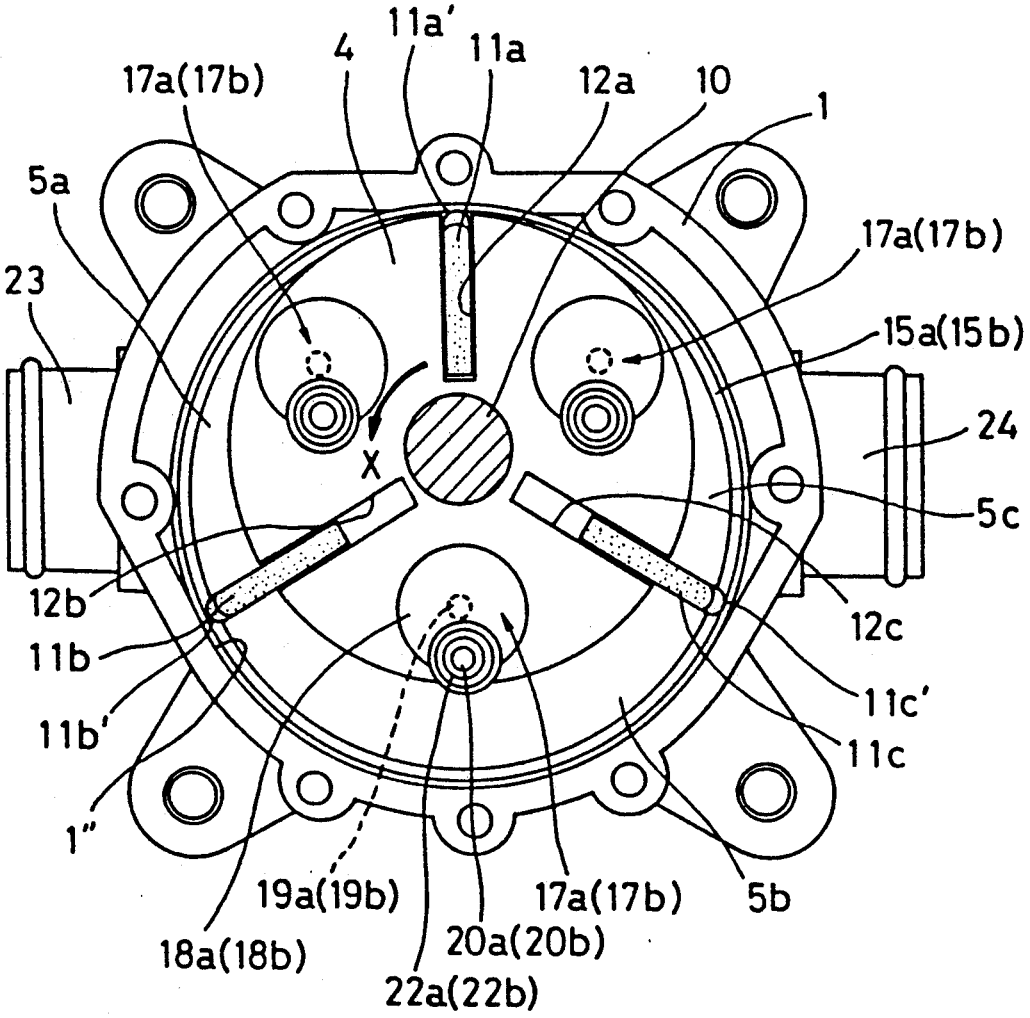
FIG. 6 is an explanatory view of an internal construction of the FIG. 5 pump viewed axially.
Figure 7:
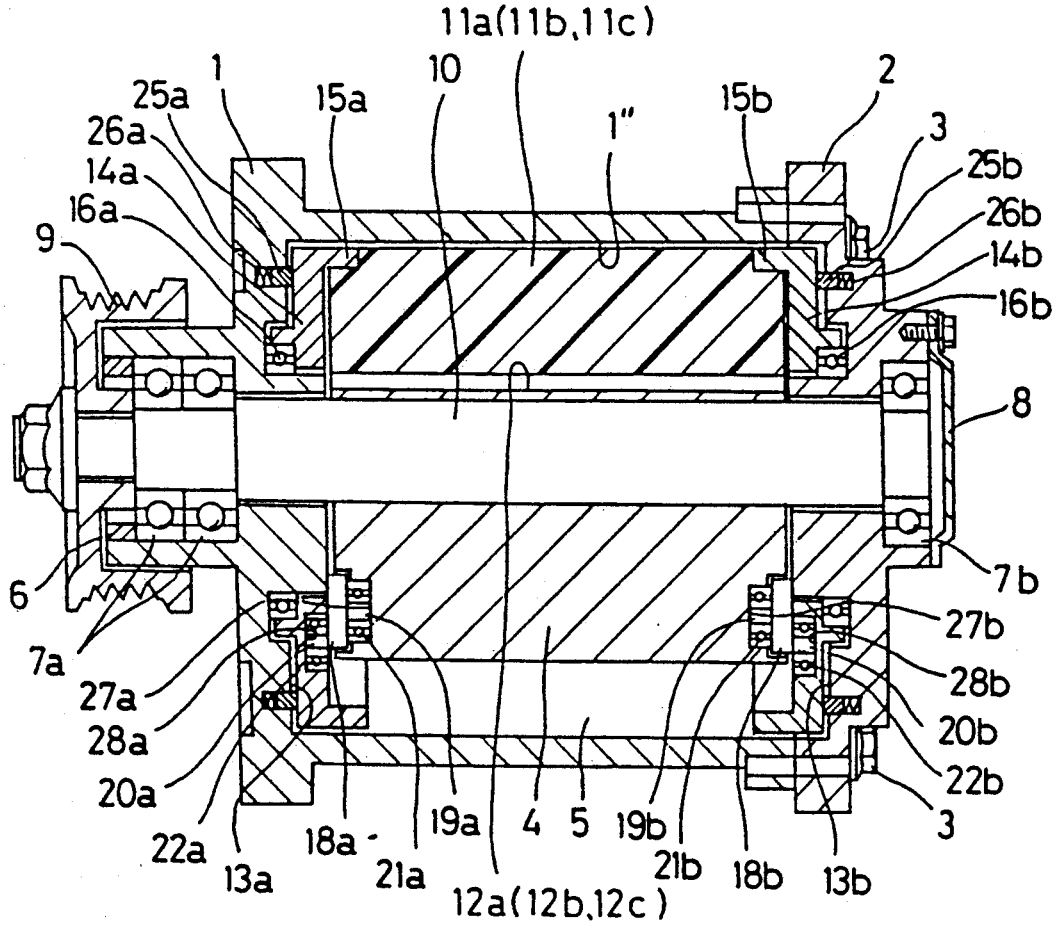
FIG. 7 is a sectional view of a vane pump according to a further embodiment of the present invention.

In FIGS. 5 and 7, a front housing 1 and a rear housing 2, which both housings are made of non-ferrous metal such as aluminum which is light in weight and is small in coefficient of thermal expansion, are secured integral with each other by means of bolts 3. A rotor 4 made of iron eccentrically inserted into an inner peripheral space 5 of the housing is extended through both the housings 1 and 2 through a ball bearing 7*a* held by a fixed ring 6 in anti-slipout fashion in an axial shoulder of the front housing 1 and a ball bearing 7*b* held by a bearing cover 8 in anti-slipout fashion in an axial shoulder of the rear housing 2 and is rotatably mounted on a rotational shaft 10 to which a drive force is transmitted from a pulley 9. Plate-like vanes 11*a*, 11*b* and 11*c* principally made of a carbon material having an excellent slidability are disposed to be radially projected and retracted in vane grooves 12*a*, 12*b* and 12*c*, respectively, which are formed in the form of depressions equally spaced apart so as to peripherally divide the outer peripheral side of the rotor 4 into three sections, on the rotor 4. In inner surfaces 1' and 2' opposed to each other of end walls of the front housing 1 and rear housing 2 are provided peripheral shoulders 13*a* and 13*b* formed coaxial with the inner peripheral space 5 of the housing (coaxial with the inner peripheral surface 1'' of the front housing 1). Retainer plates 14*a* and 14*b* formed of non-ferrous metal such as aluminum and having a diameter slightly smaller than the inner peripheral surface 1'' of the housing are rotatably mounted on the peripheral shoulders 13*a* and 13*b* through ball bearings 16*a* and 16*b*. On the outer peripheral ends of the retainer plates 14*a* and 14*b* are formed annular stoppers 15*a* and 15*b* projected parallel to the axis and adapted to define the protrusion of the vanes 11*a*, 11*b* and 11*c*. Reference numeral 17*a* designates a cam whereby the rotor 4 and the retainer plate 14*a* are rotatably connected between opposed ends thereof and is constructed such that a pin 19*a* rotatably axially inserted in a position where one end of the rotor 4 is peripherally equally divided into three sections through a ball bearing 21*a* is secured in the central portion of one side of each disk 18*a*, and a pin 20*a* rotatably axially inserted in a position where the retainer plate 14*a* is peripherally equally divided into three sections through a ball bearing 22*a* is secured to the outer end of the other side of each disk 18*a*. Reference numberal 17*b* designates a cam whereby the rotor 4 and the retainer plate 14*a* are rotatably connected between opposed ends thereof and is constructed such that a pin 19*b* rotatably axially inserted in a position where the other end of the rotor 4 is peripherally equally divided into three sections through a ball bearing 21*b* is secured in the central portion of one end of each disk 18*b*, and a pin 20*b* rotatably axially inserted in a position where the retainer plate 14*b* is peripherally equally divided into three sections through a ball bearing 22*b* is secured to the outer end of the other side of each disk 18*b*. The pins 19*a*, 19*b* and pins 20*a*, 20*b* are on the circumference of the same diameter eccentric to each other by an eccentric amount of the rotor 4. The retainer plates 14*a*, 14*b* are rotated in synchronism with the rotor 4 by the cams 17*a*, 17*b*. Reference numeral 23 designates an intake port for introducing a fluid from the outside into the inner peripheral space 5 of the housing, and reference numeral 24 designates a discharge port for introducing a fluid from the inner peripheral space 5 of the housing toward the outside.

Next, the operation of the aforementioned vane pump will be described. When the rotational shaft 10 and the rotor 4 are rotated in the direction as indicated at X by the drive force from the pulley 9, the vanes 11*a*, 11*b* and 11*c* also rotate. Here, the protrusion the vanes 11*a*, 11*b* and 11*c* caused by the centrifugal force resulting from the aforesaid rotation is defined by the contact between the rotor 4 and the stoppers 15*a* and 15*b* on the outer peripheral ends of the retainer plates 14*a* and 14*b*, and accordingly, the vanes 11*a*, 11*b* and 11*c* rotate in a state leaving a slight clearance (in a non-contact state) between the vanes and the inner peripheral surface 1'' of the housing and are in a state not in contact with both the inner surfaces 1' and 2' of the housing with the provision of the retainer plates 14*a* and 14*b*. Since the inner peripheral surface 1'' and the stoppers 15*a*, 15*b* are in a relation of being coaxial with each other and the stoppers 15*a*, 15*b* and the rotor 4 are in a relation of being eccentric with each other, the vanes 11*a*, 11*b* and 11*c* are radially slidably moved in the vane grooves 12*a*, 12*b* and 12*c* of the rotor 4 and repeatedly projected and withdrawn. As the result, the volume of the working spaces 5*a*, 5*b* and 5*c* defined by the housings 1, 2, the rotor 4 and the vanes 11*a*, 11*b* and 11*c* is repeatedly increased and decreased. That is, FIG. 6 shows the process in which the working space 5*a* increases its volume as the rotation takes place and sucks the fluid from the intake port 23 open to portion 5*a*; the working space 5*c* decreases its volume as the rotation takes place and discharges the fluid into the discharge port 24 open to portion 5*c*; and the working space 5*b* transfers the sucked fluid toward the discharge port 24.

In the above-described operation, the vanes 11*a*, 11*b* and 11*c* are totally free from sliding contact with the inner peripheral surface 1'' of the housing and both the inner surfaces 1' and 2', and the end edges 11*a'*, 11*b'* and 11*c'* of the vanes come into sliding contact with the stoppers 15*a*, 15*b* of the retainer plates 14*a*, 14*b* only at their both axial side ends. However, since the stoppers 15*a*, 15*b* are rotated in synchronism with the rotor 4, the aforesaid sliding amount is small and thus the lowering of the efficiency and the advance of the wear resulting from sliding resistance and sliding heat generation can be minimized, and the temperature of the fluid discharged from the discharge port 24 can be lowered. In addition, according to the aforementioned arrangement, since the stoppers 15*a*, 15*b* which define the protrusion of the vanes 11*a*, 11*b* and 11*c* are very close to the inner peripheral surface 1'' of the housing, the locus of the end edges 11*a'*, 11*b'* and 11*c'* of the vanes is approximately circular in shape, despite the repeated change of the relative angle between the vanes 11*a*, 11*b* and 11*c* and the inner peripheral surface 1'' of the housing, and the vanes rotate always leaving a given fine clearance (in a state not in contact) relative to the inner peripheral surface 1'' of the housing. While in the above-described embodiment, the cam is used to rotate the retainer plates in synchronism with the rotor, it is noted that similar effects may be obtained by an arrangement wherein the retainer plates are rotated approximately in synchronism with the rotor by the frictional force between the vanes and the stoppers. In addition, while in the above-described embodiment, the stoppers are annularly formed, it is noted that in the case where the retainer plates are rotated in synchronism with the rotor by the cam, portions of the stoppers in contact with the vanes are restricted, and therefore the stoppers can be formed in the form of an arc corresponding to those portions.

Next, a further embodiment of the present invention will be described with reference to FIG. 7. The second embodiment is, in addition to the features of the pump according to the first embodiment, characterized in that back-up rings 25*a* and 25*b* for restraining a deflection of the retainer plates are interposed between the retainer plates and the end wall of the housing. The vanes 11*a*, 11*b* and 11*c* are supported on the retainer plates 14*a* and 14*b* by contact of the vanes with the stoppers 15*a* and 15*b* as previously described. To provide the smooth projection and retraction of the vanes 11*a*, 11*b* and 11*c*, the retainer plates 14*a* and 14*b* must be firmly supported and smoothly rotated in order not to oscillate the retainer plates 14*a* and 14*b*. Practically, however, the ball bearings 16*a* and 16*b* oscillate in the thrust direction, and the retainer plates 14*a* and 14*b* oscillate due to the pressure distribution within the working space 5 into contact with the end walls of the housings 1 and 2, resulting in a deviation or an inclination of the vanes 11*a*, 11*b* and 11*c*. The present pump takes this into consideration beforehand, and the backup rings 25*a* and 25*b* are interposed between the retainer plates 14*a* and 14*b* and the end walls of the housings 1 and 2 to prevent the oscillation of the retainer plates 14*a* and 14*b*. The backup rings 25*a* and 25*b* made of non-lubrication sliding material such as carbon and resin are fitted in the annular grooves positioned partly of the peripheral shoulders 13*a* and 13*b*, and the ends thereof are brought into contact with the back of the retainer plates 14*a* and 14*b*. In addition, a number of coil springs 26*a* and 26*b* are provided as needed to strengthen the supporting force, thus preventing the oscillation of the retainer plates 14*a* and 14*b* to prevent the retainer plates 14*a* and 14*b* from contacting the end wall of the housing to indirectly secure the smooth operation of the vanes 11*a*, 11*b* and 11*c*. In this pump, the cams 17*a* and 17*b* may be removed to simplify the construction; and when a dynamic pressure bearing such as a spiral groove, a herringbone groove, etc. is provided in a contact surface between the retainer plates 14*a*, 14*b* and the backup rings 25*a*, 25*b*, the sliding resistance of this portion can be reduced to make the rotation of the retainer rings 14*a* and 14*b* smooth. Reference numerals 27*a*, 27*b*, 28*a* and 28*b* designate recesses for receiving the cams 17*a*, 17*b*, and bearings 21*a*, 21*b*, 22*a* and 22*b*.

A further exemplication of a vane pump according to the present invention will be described hereinafter with reference to FIGS. 8 to 12.

Figure 8:
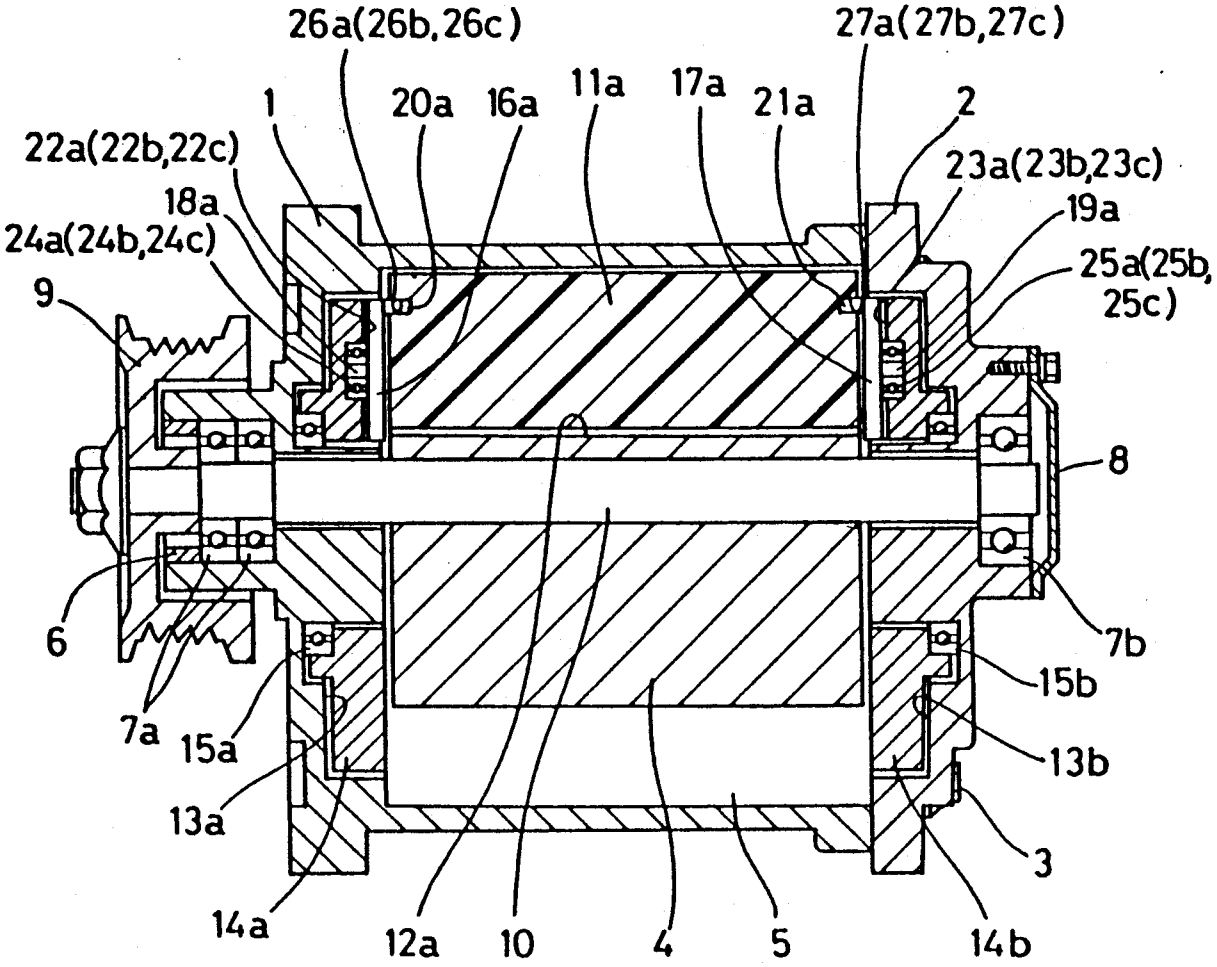
FIG. 8 is a sectional view of a vane pump according to another exemplification of the present invention.
Figure 9:
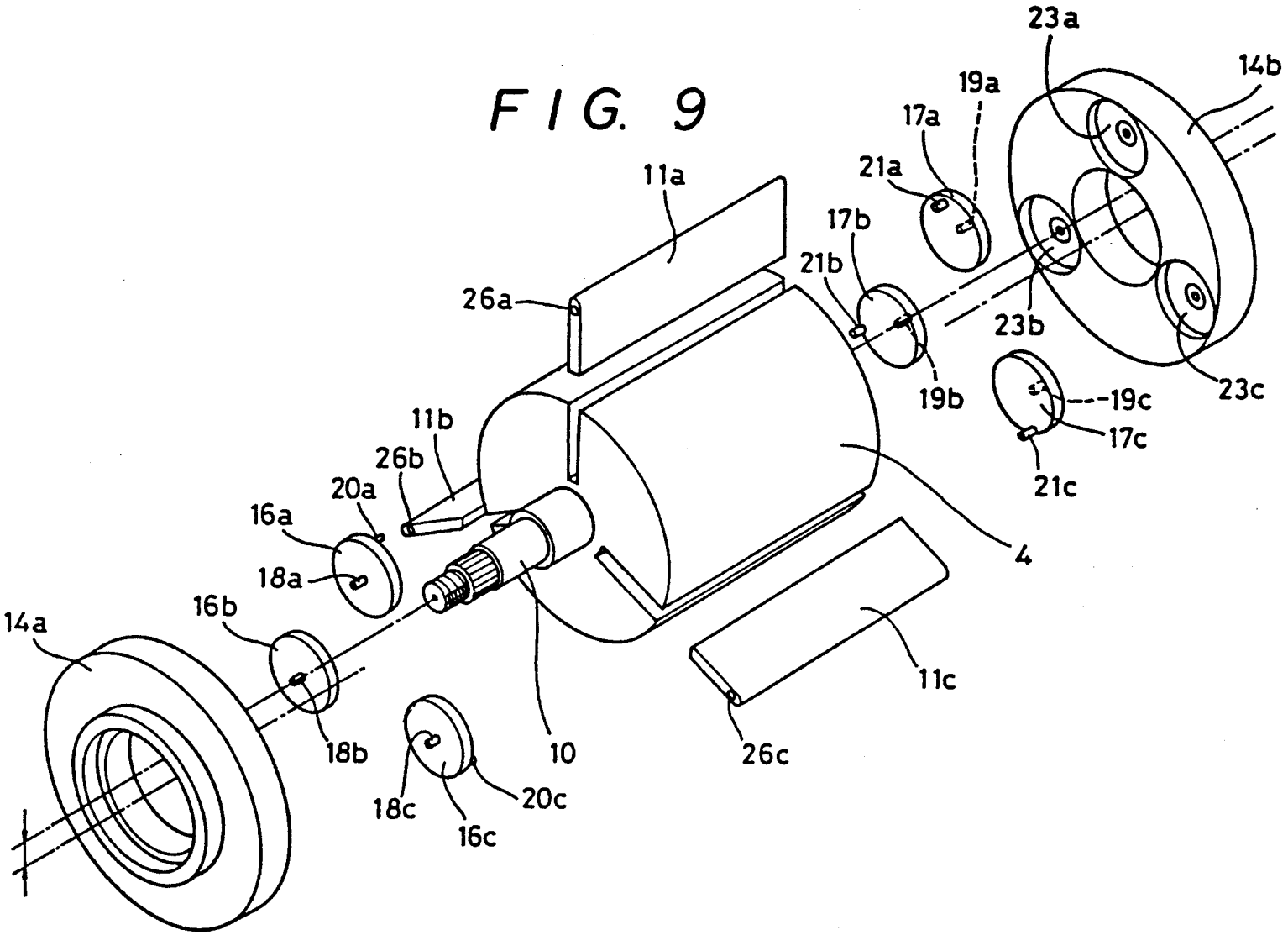
FIG. 9 is an exploded perspective view of an essential part of the FIG. 8 vane pump.
Figure 10:
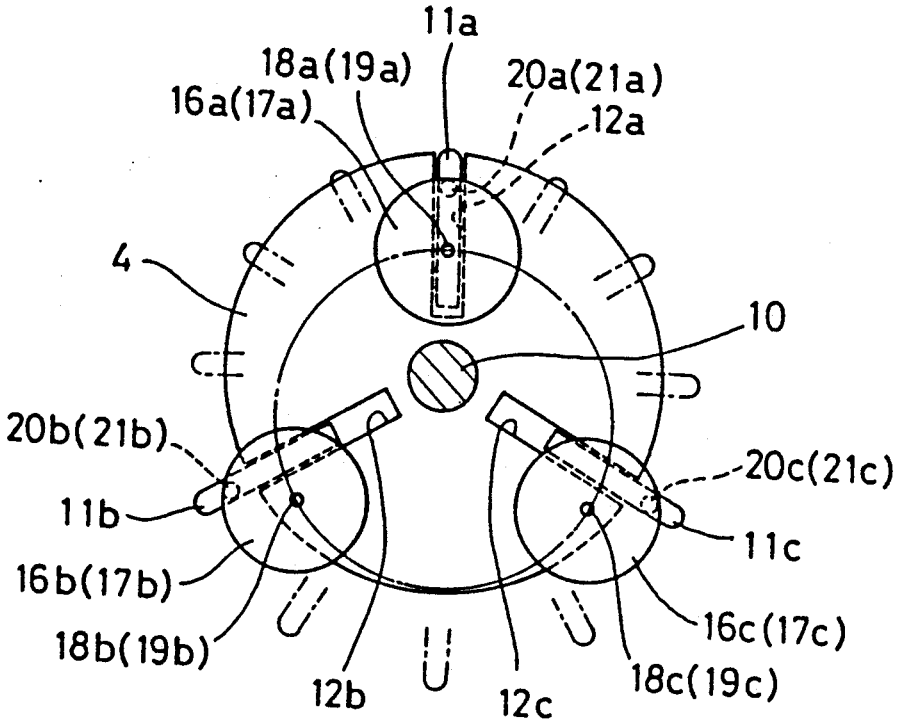
FIG. 10 is an explanatory view of the operation of the FIG. 8 vane pump.

In FIGS. 8 to 10 showing a first embodiment, a front housing 1 and a rear housing 2, which both housings are made of non-ferrous metal such as aluminum which is light in weight and is small in the coefficient of thermal expansion, are secured integral with each other by means of bolts. A rotor 4 made of iron eccentrically inserted into an inner peripheral space 5 of the housing is extended through both the housings 1 and 2 through a ball bearing 7*a* held by a fixed ring 6 in anti-slipout fashion in an axial shoulder of the front housing 1 and a ball bearing 7*b* held by a bearing cover 8 in anti-slipout fashion in an axial shoulder of the rear housing 2 and is rotatably mounted on a rotational shaft 10 to which a drive force is transmitted from a pulley 9. Plate-like vanes 11*a*, 11*b* and 11*c* principally made of a carbon material having an excellent slidability are disposed to be radially projected and retracted in vane grooves 12*a*, 12*b* and 12*c*, respectively, which are formed in the form of depressions equally spaced apart so as to peripherally divide the outer peripheral side of the rotor 4 into three sections, on the rotor 4. In annular recesses 13*a* and 13*b* formed in inner surfaces of end walls where the front housing 1 and rear housing 2 are opposed to each other coaxial with the inner peripheral space 5 of the housing (coaxial with an inner peripheral surface of the front housing 1), retainer plates 14*a* and 14*b* made of non-ferrous metal such as aluminum are rotatably fitted through ball bearings 15*a* and 15*b*, respectively. The vanes 11*a*, 11*b* and 11*c* are brought into engagement with the retainer plates 14*a* and 14*b* through cams 16*a*, 16*b*, 16*c*, 17*a*, 17*b* and 17*c*. The cams 16*a*, 16*b*, 16*c*, 17*a*, 17*b* and 17*c* fitted in recesses 22*a*, 22*b*, 22*c*, 23*a*, 23*b* and 23*c* equally spaced apart into three sections in the inner surface of the retainer plates 14*a* and 14*b* are rotatably provided on the retainer plates 14*a* and 14*b* through ball bearings 24*a*, 24*b*, 24*c*, 25*a*, 25*b* and 25*c*, with first pins 18*a*, 18*b*, 18*c*, 19*a*, 19*b* and 19*c* in engagement with the retainer plates 14*a* and 14*b* projected around one surface (outer surface) of a circular rotary plate, and are rotatably engaged with engaging recesses 26*a*, 26*b*, 26*c*, 27*a*, 27*b* and 27*c* in which second pins 20*a*, 20*b*, 20*c*, 21*a*, 21*b* and 21*c* are formed on the side ends of the vanes 11*a*, 11*b* and 11*c*, with second pins 20*a*, 20*b*, 20*c*, 21*a*, 21*b* and 21*c* in engagement with the vanes 11*a*, 11*b* and 11*c* projected in the vicinity of the peripheral edge of the other surface (inner surface) of the rotary plate. The engaging recesses 26*a*, 26*b*, 26*c*, 27*a*, 27*b* and 27*c* are provided close to the outer ends of the side ends of the vanes 11*a*, 11*b* and 11*c*. As shown in FIG. 10, at the top position in which the vane 11*a* is retracted most deeply within the vane groove 12*a*, the pins 18*a*, 19*a*, 20*a* and 21*a* of the cams 16*a* and 17*a* are laid on the vane 11*a*, and the second pins 20*a* and 21*a* are positioned close to the other ends of the first pins 18*a* and 19*a*.

The operation of the vane pump will be described hereinafter. When the rotational shaft 10 and the rotor 4 are rotated by the drive force from the pulley 9, the vanes 11*a*, 11*b* and 11*c* also rotate, and the torque is transmitted from the vanes 11*a*, 11*b* and 11*c* to the retainer plates 14*a* and 14*b* through the cams 16*a*, 16*b*, 16*c*, 17*a*, 17*b* and 17*c*. The retainer plates 14*a* and 14*b* rotate coaxially with respect to the peripheral surface of the housing, as a consequence of which the cams 16*a*, 16*b*, 16*c*, 17*a*, 17*b* and 17*c* fitted in the recesses 22*a*, 22*b*, 22*c*, 23*a*, 23*b* and 23*c* of the retainer plates 14*a* and 14*b* also rotate (revolve) coaxially with respect to the inner peripheral surface of the housing. Since the rotor 4 is rotatably mounted in eccentric relation with respect to the inner peripheral surface of the housing, as previously mentioned, the vane 11*a* and the cams 16*a* and 17*a* laid one above another at the top position are deviated with the rotation (but they are again laid one above another at the bottom position which is symmetrical with the top position through 180 degrees) at which the vane 11*a* is moved out of the vane grooves 12*a* farthest. With this arrangement, the vanes 11*a*, 11*b* and 11*c* connected to the retainer plates 14*a* and 14*b* through the cams 16*a*, 16*b*, 16*c*, 17*a*, 17*b* and 17*c* are radially slidably moved and repeatedly projected and retracted into the vane grooves 12*a*, 12*b* and 12*c* of the rotor 4 with the result that volumes of the working space defined by the housings 1, 2, the rotor 4 and the vanes 11*a*, 11*b* and 11*c* are repeatedly increased and decreased to transfer the fluid from the intake port not shown to the outlet port. In the above-described operation, the protrusion of the vanes 11*a*, 11*b* and 11*c* from the vane grooves 12*a*, 12*b* and 12*c* is defined, and the vanes are rotated not in contact with the inner peripheral surface of the housing, thereby eliminating the loss of torque and preventing wear and generation of heat.

Figure 11:
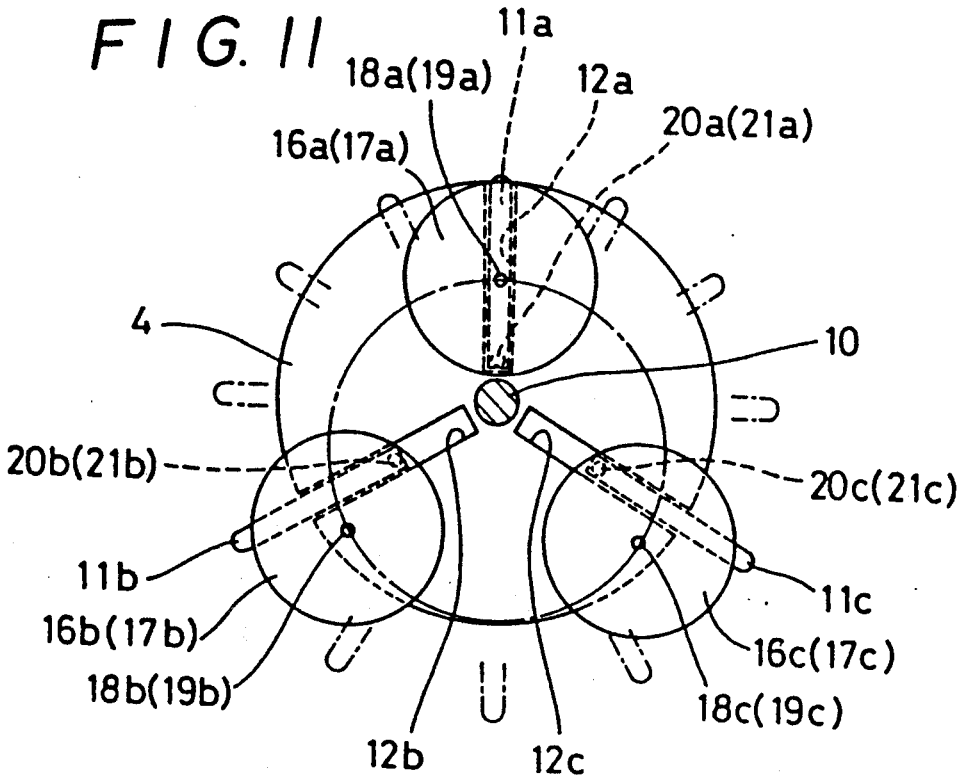
FIG. 11 is an explanatory view of the operation of a vane pump according to a further embodiment of the present invention.

FIG. 11 shows a further embodiment of the present invention in which second pins 20*a* and 21*a* of cams 16*a* and 17*a* superposed to vanes 11*a* at the top position are positioned toward the inner ends of first pins 18*a* and 19*a*, the engaging recesses 26*a*, 26*b*, 26*c*, 27*a*, 27*b* and 27*c* formed in the side ends of the vanes 11*a*, 11*b* and 11*c*, respectively, being provided toward the inner ends of these side ends. Other structures are the same as those of the aforementioned first embodiment, and the description thereof will be omitted with reference numerals merely affixed.

In the above-described both embodiments, the locus of the end edges of the vanes 11*a*, 11*b* and 11*c* whose protrusion is defined is not always circular, and it is therefore desired that in designing the pump, dimensions and arrangements of parts are adjusted so that the locus is made close to a circle. However, conversely, the inner peripheral surface of the housing is not made to be circular but adjusted to the locus so that the end edges of the vanes 11*a*, 11*b* and 11*c* and the clearance in the inner peripheral surface of the housing are maintained to be equal to each other over the whole periphery.

Figure 12:
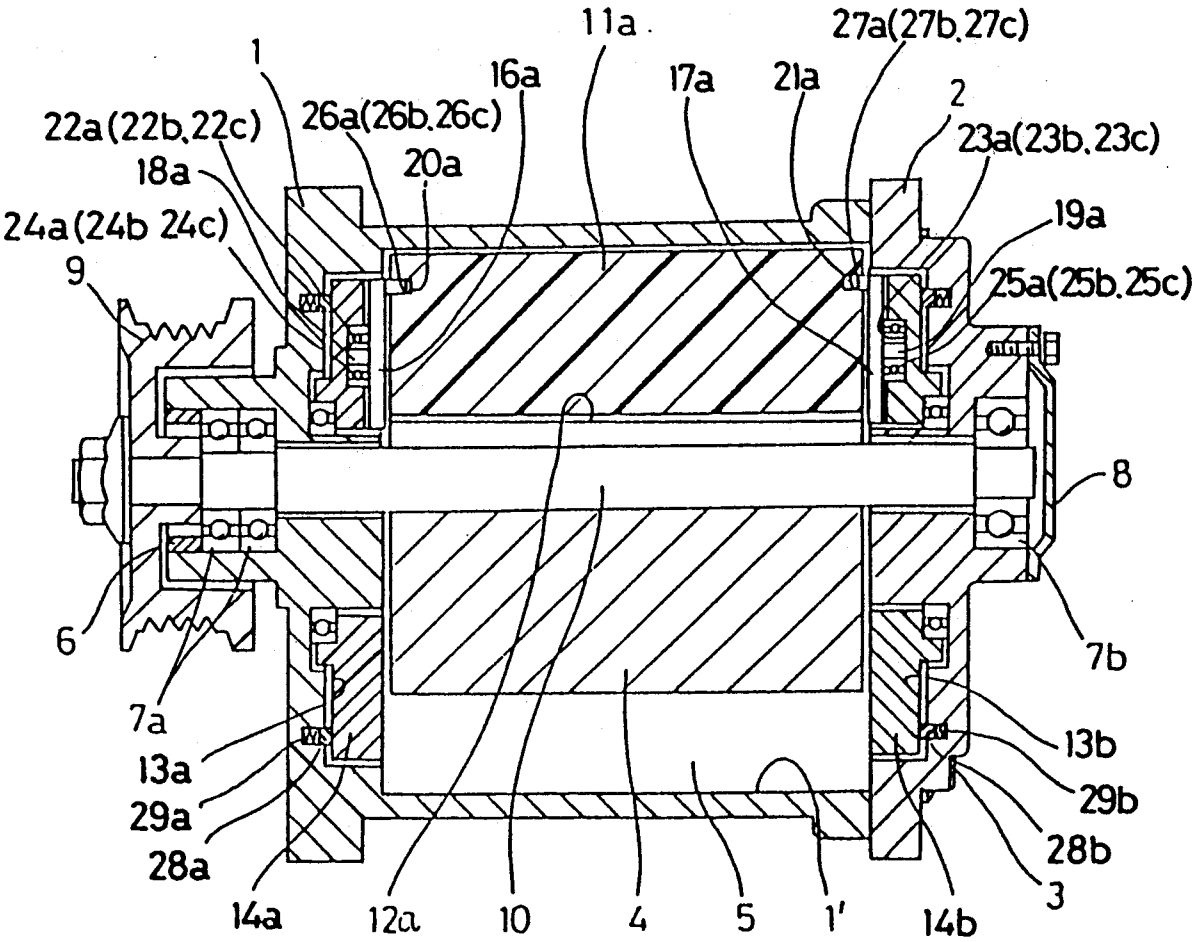
FIG. 12 is a sectional view of a vane pump according to yet another embodiment of the present invention.
Figure 13:
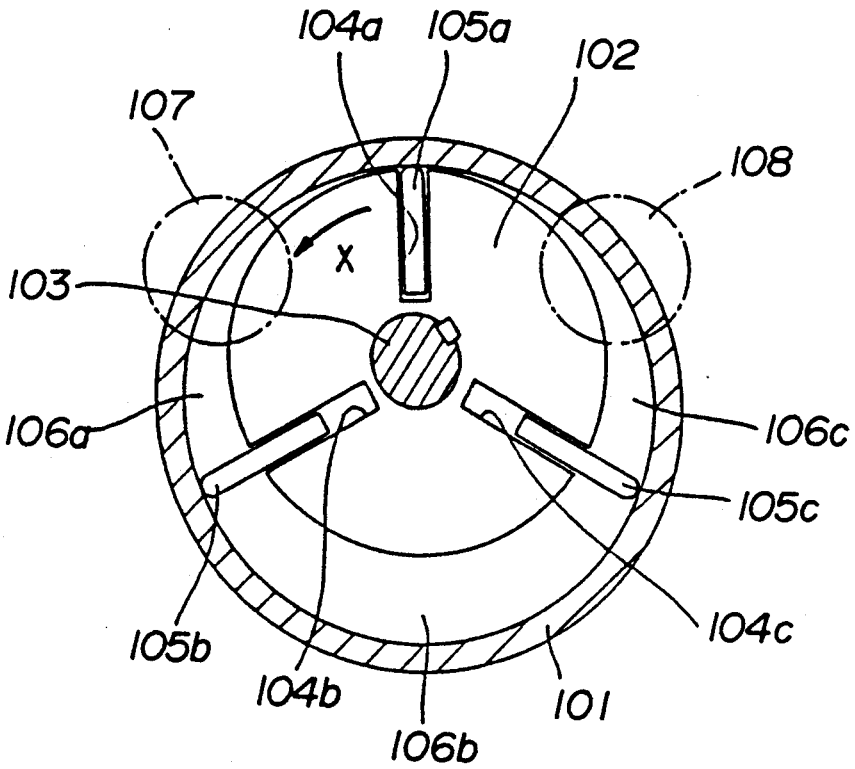
FIG. 13 PRIOR ART
FIG. 13 is a sectional view showing one example of a vane pump according to the prior art.

Next, a further embodiment of the present invention will be described with reference to FIG. 12. The third embodiment is, in addition to the features of the pump according to the first embodiment, characterized in that backup rings 28*a* and 28*b* for restraining a deflection of the retainer plates are interposed between the retainer plates and the end walls of the housing. The vanes 11*a*, 11*b* and 11*c* are supported on the retainer plates 14*a* and 14*b* through the cams 16*a*, 16*b*, 16*c*, 17*a*, 17*b* and 17*c*. To provide the smooth projection and retraction of the vanes 11*a*, 11*b* and 11*c*, the retainer plates 14*a* and 14*b* must be firmly supported and smoothly rotated in order not to oscillate the retainer plates 14*a* and 14*b*. Practically, however, the ball bearings 15*a* and 15*b* oscillate in the thrust direction, and the retainer plates 14*a* and 14*b* oscillate due to the pressure distribution within the working space 5 into contact with the end walls of the housings 1 and 2, resulting in a deviation or an inclination of the vanes 11*a*, 11*b* and 11*c*. The present pump takes this into consideration beforehand and the backup rings 28*a* and 28*b* are interposed between the retainer plates 14*a* and 14*b* and the end walls of the housings 1 and 2 to prevent the oscillation of the retainer plates 14*a* and 14*b*. The backup rings 28*a* and 28*b* made of non-lubrication sliding material such as carbon and resin are fitted in annular grooves positioned partly of the annular recesses 13*a* and 13*b*, and the ends thereof are brought into contact with the back of the retainer plates 14*a* and 14*b*. In addition, a number of coil springs 29*a* and 29*b* are provided as needed to strengthen the supporting force, thus preventing the oscillation of the retainer plates 14*a* and 14*b* to prevent the retainer plates 14*a* and 14*b* from contacting the end wall of the housing to indirectly secure the smooth operation of the vanes 11*a*, 11*b* and 11*c*.

While we have described the preferred embodiment of the present invention, it will be obvious that various other modifications can be made without departing from the principle of the present invention. Accordingly, it is desired that all the modifications that may substantially obtain the effect of the present invention through the use of the structure substantially identical with or corresponding to the present invention are included in the scope of the present invention.

This application incorporates herein the disclosures of U.S. Ser. Nos. 075,006, filed Jul. 17, 1987; 110,919 filed Oct. 21, 1987; 113,568 filed Oct. 26, 1987; and 115,677 filed Oct. 30, 1987.

What we claim is:

1. A rotary machine comprising a housing having a rotor chamber, said rotor chamber having an inner peripheral surface, a rotor means rotatably mounted in said rotor chamber, said rotor means having an axis of rotation, said inner peripheral surface having a central axis which is eccentrically disposed relative to said axis of rotation of said rotor means, said rotor means having longitudinal ends and a plurality of generally radially disposed vane slots extending between said longitudinal ends, a plurality of vane means slidably mounted in said vane slots and operable to define variable volume chambers as said rotor means rotates and said vane means move generally radially in and out of said vane slots, ring means rotatably mounted on said housing, limiting means between said ring means and said vane means operable to limit the extent of outward radial movement of said vane means from its respective vane slot during rotation of said rotor means to preclude sliding contact between said vane means and said inner peripheral surface of said housing, and biasing means on said housing engageable with said ring means and biasing said ring means in an axial direction toward said longitudinal ends of said rotor means to thereby suppress axial oscillation of said ring means and stabilize the rotation of said ring means.

2. A rotary machine according to claim 1, wherein said rotor means comprises a rotor shaft, shaft bearing means on said housing rotatably supporting said rotor shaft, said biasing means being disposed radially outwardly of said shaft bearing means.

3. A rotary machine according to claim 1, wherein said biasing means comprises backup rings and springs biasing said backup rings in an axial direction toward said longitudinal ends of said rotor means.

4. A rotary machine according to claim 1, wherein said biasing means comprises backup rings, said backup rings comprising a carbon material.

5. A rotary machine according to claim 1, wherein said biasing means comprises backup rings, said backup rings comprising a resin material.

6. A rotary machine according to claim 1, wherein said biasing means comprises spring means.

7. A rotary machine according to claim 6, wherein said spring means comprises coil springs.

8. A rotary machine according to claim 1, wherein said rotor means has a rotor shaft, shaft bearing means on said housing rotatably supporting said rotor shaft, said housing having inner end walls defining the longitudinal ends of said rotor chamber, said end walls being perpendicular to said central axis, said end walls having an annular groove spaced radially outwardly of said shaft bearing means, said biasing means being disposed in said annular groove.

9. A rotary machine comprising a housing having a rotor chamber, said rotor chamber having an inner peripheral surface, a rotor means rotatably mounted in said rotor chamber, said rotor means having an axis of rotation, said inner peripheral surface having a central axis which is eccentrically disposed relative to said axis of rotation of said rotor means, said rotor means having longitudinal ends and a plurality of generally radially disposed vane slots extending between said longitudinal ends, a plurality of vane means slidably mounted in said vane slots and operable to define variable volume chambers as said rotor means rotates and said vane means move generally radially in and out of said vane slots, said vane means having longitudinal ends, said housing having annular ring means coaxial with said peripheral surface of said rotor chamber, said ring means having an inner cylindrical surface disposed to be engaged by said longitudinal ends of said vane means such that during rotation of said rotor means, the resulting centrifugal force urges said vane means radially outwardly of the respective vane slot such that said longitudinal ends engage said inner cylindrical surface, said inner cylindrical surface being disposed to limit the extent of outward radial movement of said vane means from its respective vane slot to preclude sliding contact between said vane means and said inner peripheral surface of said housing, and biasing means in said housing engageable with said ring means and biasing said ring means in an axial direction toward said longitudinal ends of said rotor means to thereby suppress axial oscillation of said ring means and stabilize the rotation of said ring means.

10. A rotary machine according to claim 9, wherein said ring means has an annular groove defined in part by said inner cylindrical surface, said biasing means being disposed radially outwardly of said annular groove of said ring means.

11. A rotary machine according to claim 9, wherein said biasing means comprises springs mounted in an annular recess in said housing.

12. A rotary machine according to claim 10, wherein said ring means has a radial outer portion disposed radially outwardly of said annular groove in said ring means, said biasing means engaging said radial outer portion of said ring means.

13. A rotary machine according to claim 9, wherein said biasing means comprises backup rings mounted in said housing and coaxial with said central axis, said biasing means further comprising springs in said housing biasing said backup rings in said axial direction toward said longitudinal ends of said rotor means.

14. A rotary machine according to claim 9, wherein said vane means comprises projecting means projecting from said longitudinal ends of said vane means, said projecting means engaging said inner cylindrical surface of said ring means.

15. A rotary machine according to claim 14, wherein said biasing means is disposed radially outwardly of said projecting means.

16. A rotary machine according to claim 9, wherein said ring means has an annular channel, said channel having a generally U-shaped cross-sectional configuration extending uninterruptedly throughout its annular extent.

17. A rotary machine according to claim 16, wherein said channel has two radially spaced cylindrical surfaces and a bottom surface, one of said two radially spaced cylindrical surfaces defining said inner cylindrical surface engaged by said longitudinal ends of said vane means, said bottom surface being joined to each of said two radially spaced cylindrical surfaces.

18. A rotary machine according to claim 9 further comprising ring bearing means on said housing rotatably supporting said ring means, said biasing means being disposed radially outwardly of said ring bearing means.

19. A rotary machine according to claim 9, wherein said rotor means has a rotor shaft, shaft bearing means on said housing rotatably supporting said rotor shaft, said housing having inner end walls defining the longitudinal ends of said rotor chamber, said end walls being perpendicular to said central axis, said end walls having a first annular groove spaced radially outwardly of said shaft bearing means, said biasing means being disposed in said first annular groove, said end walls having a second annular groove disposed radially inwardly of said first annular groove, and ring bearing means in said second annular groove rotatably supporting said ring means.

20. A rotary machine according to claim 19, wherein said ring means has one side face juxtaposed to said rotor means and an opposite side face juxtaposed to said housing, said ring means having an annular projecting part projecting from said opposite side face, said annular projecting part extending into said second annular groove.

* * * * *